US006172468B1

(12) United States Patent
Holländer

(10) Patent No.: US 6,172,468 B1
(45) Date of Patent: Jan. 9, 2001

(54) METHOD AND APPARATUS FOR IGNITING A GAS DISCHARGE LAMP

(75) Inventor: Jonathan Holländer, Hod-Hasharon (IL)

(73) Assignee: Metrolight Ltd., Netanya (IL)

( * ) Notice: Under 35 U.S.C. 154(b), the term of this patent shall be extended for 0 days.

(21) Appl. No.: 09/225,044

(22) Filed: Jan. 4, 1999

(30) Foreign Application Priority Data

Jan. 14, 1997 (IL) ..... 122935

(51) Int. Cl.[7] ..... G05F 1/00
(52) U.S. Cl. ..... 315/291; 315/307
(58) Field of Search ..... 315/209 R, 119, 315/308, 175, 291, 307, 224, 225, 278, DIG. 7

(56) References Cited

U.S. PATENT DOCUMENTS

| | | | | |
|---|---|---|---|---|
| Re. 33,057 | | 9/1989 | Clegg et al. | 315/224 |
| 4,331,905 | | 5/1982 | Owen | 315/225 |
| 4,630,005 | | 12/1986 | Clegg et al. | 331/113 |
| 5,565,740 | * | 10/1996 | Hiramatsu et al. | 315/209 R |
| 5,569,984 | * | 10/1996 | Holtslag | 315/307 |
| 5,572,094 | * | 11/1996 | Yamashita et al. | 315/308 |
| 5,623,187 | * | 4/1997 | Caldeira et al. | 315/307 |
| 5,677,602 | * | 10/1997 | Paul et al. | 315/224 |
| 5,705,894 | * | 1/1998 | Krummel | 315/119 |
| 5,770,924 | * | 6/1998 | Osterried | 315/175 |

FOREIGN PATENT DOCUMENTS

| | | |
|---|---|---|
| 0239420B1 | 2/1992 | (EP) . |
| 0311424B1 | 3/1994 | (EP) . |
| WO 97/43879 | 11/1997 | (WO) . |

OTHER PUBLICATIONS

OSRAM Metal Halide Lamps Technology and Application Handbook, Jul. 1996,pp. 35–39 and 52.

* cited by examiner

*Primary Examiner*—Don Wong
*Assistant Examiner*—Chuc Tran D
(74) *Attorney, Agent, or Firm*—Darby & Darby

(57) ABSTRACT

A gas discharge lamp and a method of operating the lamp is provided. The gas discharge lamp includes a lamp, a ballast for providing an AC voltage to the lamp and a frequency changer which selects an initial AC frequency at which the ballast provides the AC voltage and which changes the AC frequency to a second AC frequency, wherein the second frequency is higher than the initial frequency.

12 Claims, 5 Drawing Sheets

METHOD AND APPARATUS FOR IGNITING A GAS DISCHARGE LAMP

FIELD OF THE INVENTION

The present invention relates to gas discharge lamps generally and to methods and apparatus for starting such lamps in particular.

BACKGROUND OF THE INVENTION

Gas discharge lamps are well known in the art and their operation is described in FIGS. 1–4, to which reference is now made. FIG. 1 generally illustrates a gas discharge lamp and indicates that such a lamp includes a bulb 10, two electrodes 12 and 14, and gas 16 within the bulb 10. The lamp is controlled by a ballast 18 which includes an igniter 19 therein. Prior art gas discharge lamps are discussed in the *OSRAM Metal Halide Lamps Technology and Application Handbook,* July 1996, pp. 35–39 and 52.

To start the lamp, igniter 19 provides a spark, of typically 2–4 kV for a cold start and 20–40 kV for a hot start, between the two electrodes 12 and 14. The spark causes the electrode acting as the cathode, such as electrode 12, to emit electrons which ionizes the gas 16. The ionized gas then provides a low current path between the electrode 12 and the electrode 14, acting as the anode, thereby reducing the amount of voltage needed to close the circuit.

To ensures that the spark becomes established as a stable steady-state arc discharge, the spark must be of a high voltage (2–40 kV), the electrical energy of the spark must be high, the ballast must provide a quick current flow and the ballast must have an adequate open circuit voltage, typically of 250V.

The spark 20 is shown in the voltage-time graph of FIG. 2. Once ignition has occurred, the gas 16 is ionized and the voltage needed to maintain a current through the lamp drops to a low, operating voltage of about 20V, remaining there until the AC voltage direction changes. If the electrodes 12 and 14 are not sufficiently warm (i.e. they do not emit enough electrons), the ionization of the gas 16 cannot be maintained and the current path is broken. Accordingly, when the voltage changes direction, the gas must be reignited.

The reignition continues until the electrodes 12 and 14 are warm enough to maintain the ionization during the voltage direction change. This typically takes 10–100 cycles, where the length T1 of half of each cycle is typically on the order of 2.5 msec. Once this occurs, the operating voltage rises to the nominal operating voltage of the lamp which is typically between 50 and 130VAC and depends on the type of the lamp. FIG. 3 shows the cycles and the changing operating voltage over time.

The high power ignition pulses cause localized "hot spots" on the electrode, melting of the metal and sputtering of the electrodes 12 and 14 which erodes them. The sputtering blackens the inside walls of the bulb 10, thereby reducing the amount of light (as measured in lumens) that the lamp provides, a phenomenon known as "lumen degradation". Furthermore, the sputtering removes material from the electrodes, as shown in FIG. 4. FIG. 4 shows electrode 12 with a very uneven end 22. As more and more material is removed, the distance between the electrodes 12 and 14 is increased and, if the distance is too far, the spark does not successfully reach from one electrode to the other. Due to the two effects of sputtering and blackening, the lamp light output degrades dramatically and, eventually, the lamp fails.

Mechanisms are known for igniting the gas with a DC voltage and, once the gas is ignited, switching to AC operation. Since the voltage never changes direction, the gas 16 remains ionized. However, in such lamps, the current only attacks the electrode 14 acting as the anode, causing sputtering and warming up electrode 14 significantly more than electrode 12. The result is that portions of electrode 14 melt down, causing more severe damage than that seen with AC ignition.

SUMMARY OF THE INVENTION

An object of the present invention is to provide a novel method of igniting a gas discharge lamp which provides minimal or no reignition operations.

There is therefore provided, in accordance with a preferred embodiment of the present invention, a gas discharge lamp which includes a lamp, a ballast for providing an AC voltage to the lamp and a frequency changer which selects an initial AC frequency at which the ballast provides the AC voltage and which changes the AC frequency to a second AC frequency, wherein the second frequency is higher than the initial frequency.

Moreover, in accordance with a preferred embodiment of the present invention, the frequency changer selects the second AC frequency once the gas discharge lamp has substantially achieved a standard operating voltage.

Still further, in accordance with a preferred embodiment of the present invention, the initial AC frequency has a period which is long enough to maintain gas ionization during an AC voltage direction change.

Additionally, in accordance with a preferred embodiment of the present invention, the change from the initial AC frequency to the second AC frequency can be any increasing function, such as a step or a ramp function.

Finally, in accordance with a preferred embodiment of the present invention, there is provided a method of operating a gas discharge lamp. The method includes the steps of initially operating the lamp at an initial alternating current (AC) frequency; and later operating the lamp at a second AC frequency.

The second AC frequency is higher than said initial AC frequency.

BRIEF DESCRIPTION OF THE DRAWINGS

The present invention will be understood and appreciated more fully from the following detailed description taken in conjunction with the appended drawings in which.

DETAILED DESCRIPTION OF THE PRESENT INVENTION

Figure 1:
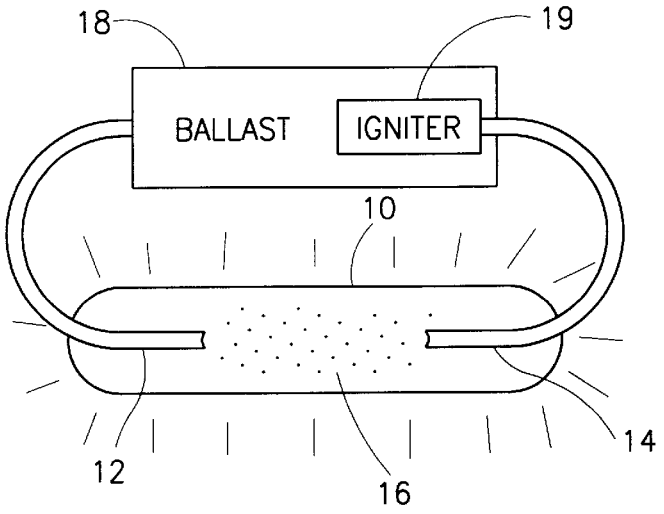
FIG.1 PRIOR ART
FIG. 1 is a schematic illustration of a prior art gas discharge lamp.
Figure 2:
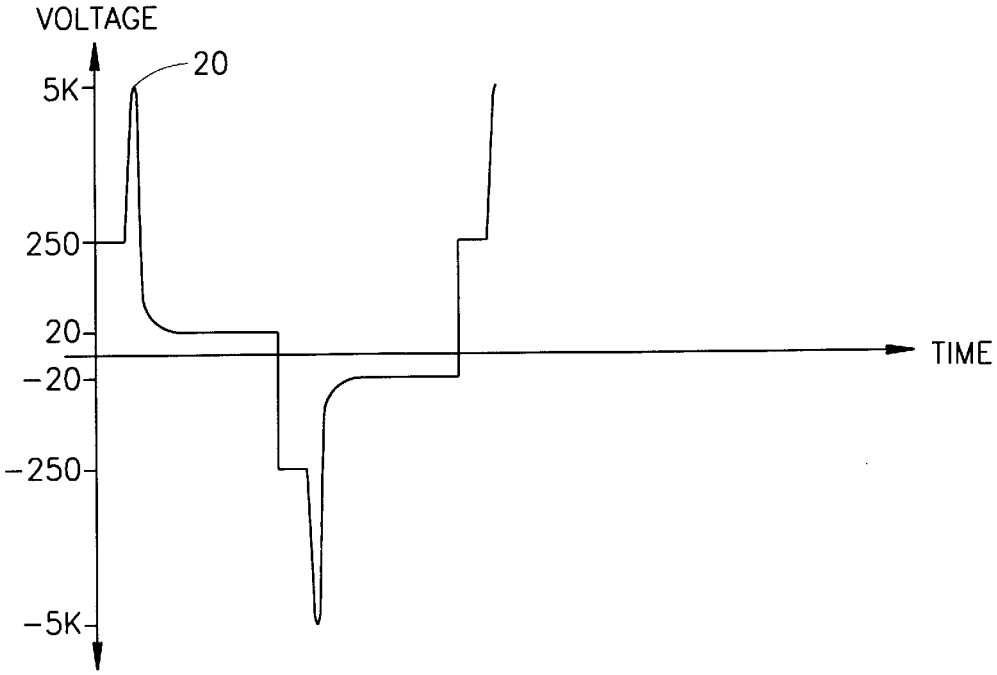
FIG.2 PRIOR ART
FIG. 2 is a graphical illustration of the voltage required for igniting a prior art gas discharge lamp.
Figure 3:
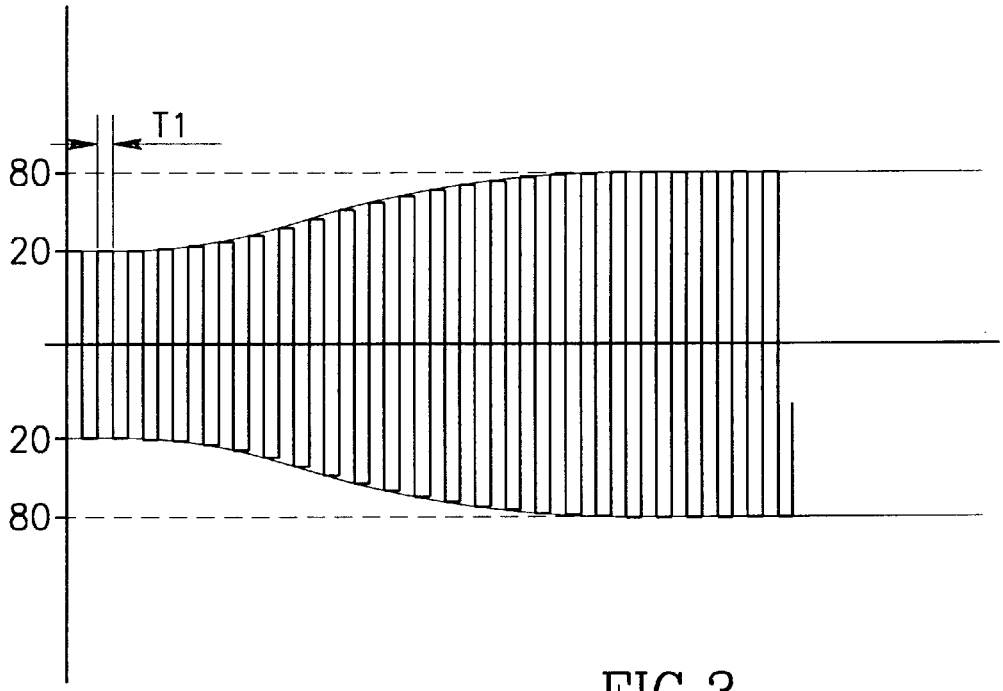
FIG.3 PRIOR ART
FIG. 3 is a graphical illustration of the voltage required by the prior art as discharge lamp over time.
Figure 4:
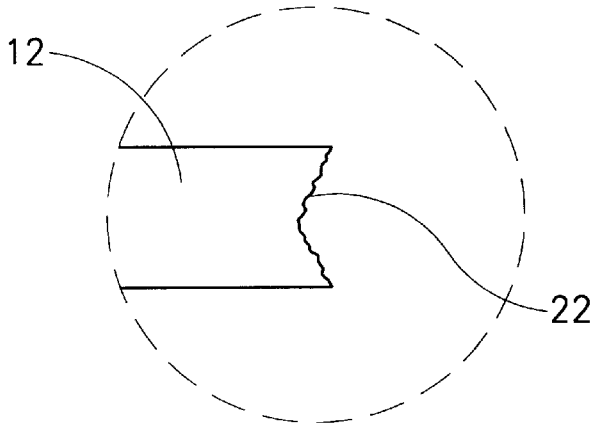
FIG.4 PRIOR ART
FIG. 4 is a schematic illustration of the shape of a prior art electrode after significant sputtering.

Applicant has realized that, if the electrodes 12 and 14 of FIG. 1 are sufficiently warm, they will maintain the gas ionization during the change in voltage direction. If this is true, one or only a few high voltage sparks will be required to ignite the gas. Applicant has further realized that the electrodes can be warmed up within an AC voltage operation, provided that the frequency of the voltage change is relatively slow. Once the gas is fully ignited, the AC frequency can be returned to the standard higher operating frequency.

Figure 5:
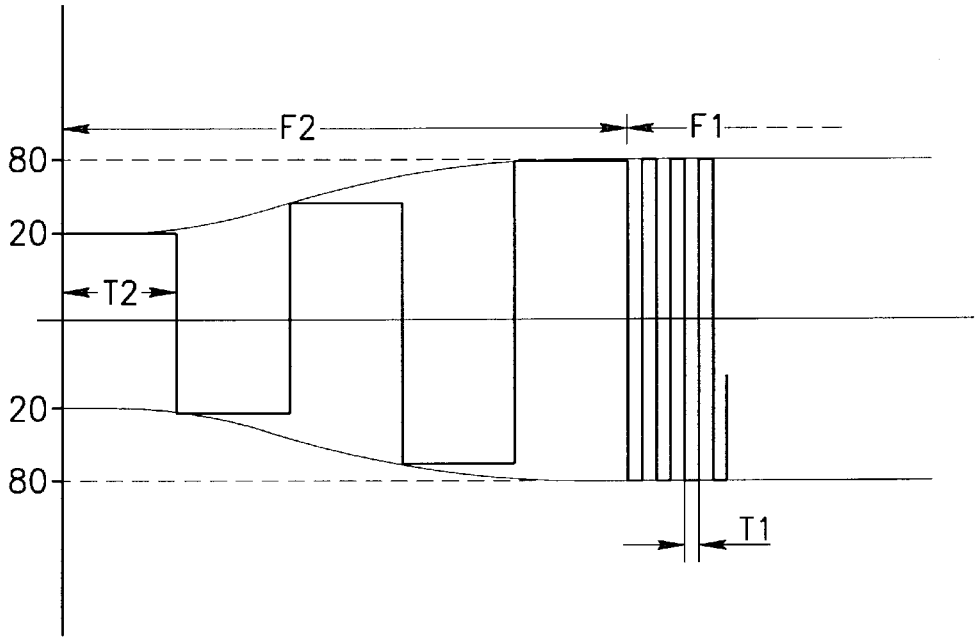
FIG. 5 is a graphical illustration of a dual frequency operating method, in accordance with a preferred embodiment of the present invention.
Figure 6:
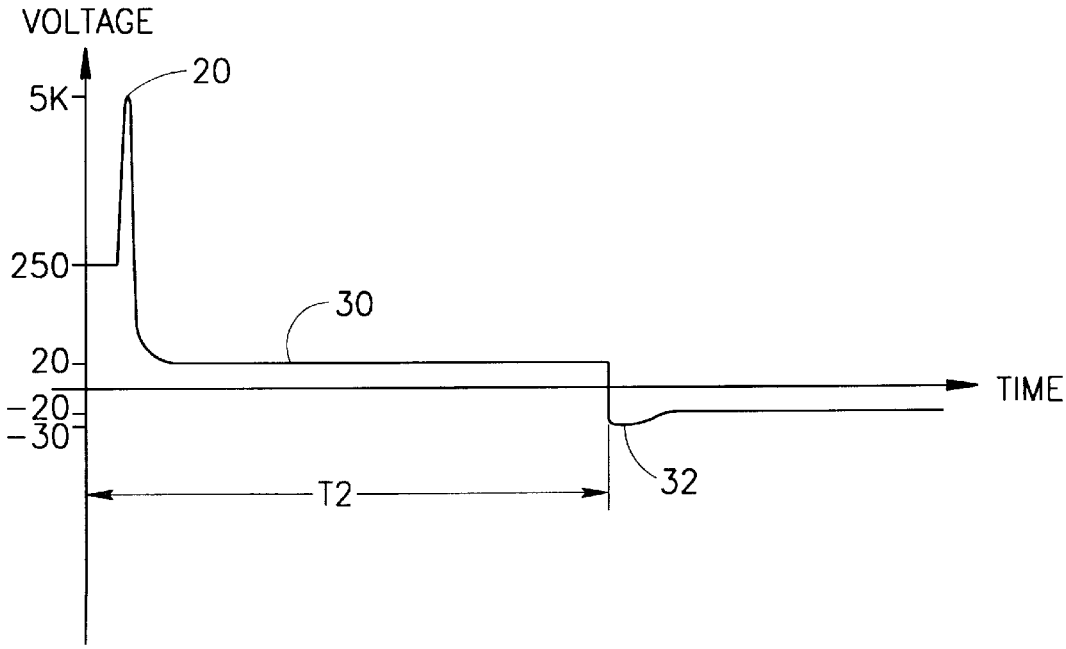
FIG. 6 is a graphical illustration of the voltage required for igniting a gas discharge lamp.

Reference is now made to FIG. 5 which illustrates the dual frequency operation method of the present invention and to FIG. 6 which illustrates the voltage levels at the beginning of the operation. The elements of FIG. 1 will also be referred to using the reference numerals found in FIG. 1.

In accordance with a preferred embodiment of the present invention, the ballast 18 ignites the gas discharge lamp by operating at a low frequency F2 which is lower than the standard operating frequency F1. For example, the standard operating frequency might be 100 Hz and the low frequency F2 might be 10 Hz. A ratio of 10:1 between F1 and F2 is considered practical.

The selection of the low frequency F2 is a function of the construction and performance characteristics of the lamp and, in particular, of the amount of time necessary to sufficiently warm the electrodes 12 and 14 so that ionization is maintained during the change in voltage direction, at a standard operating temperature, such as 25° C.

FIG. 6 shows the initial voltage levels of a gas discharge lamp operating in accordance with the present invention. The initial spark 20 ignites the gas 16 and, after the spark, the voltage drops to about 20V due to the current path provided by the ionized gas. This low voltage, labeled 30, is maintained until the end of the half-period T2, at which time the AC voltage changes direction.

Since, in the first AC voltage direction, current flowed from electrode 14 acting as the anode to electrode 12 acting as the cathode, electrode 14 heated up more than electrode 12. Thus, with the change in voltage direction, electrode 12 (which acts now as an anode) is cooler and does not emit as many electrons as electrode 14 previously did. The current path is weakened; however, since the electrodes 12 and 14 were sufficiently warm, the gas ionization is maintained. Since the electrode 12 (cathode) is cooler than electrode 14, the voltage across the electrodes increases slightly for a short period, as indicated by reference numeral 32.

The time T2 should be long enough to have electrode 12 warm up to sustain the arc, and short enough not to overheat electrode 14. If the ballast 18 is of the type which controls current, rather than voltage, the ballast can provide extra current during the ignition phase. This enables the time T2 to be shorter. For example, the current for the ignition phase can be set to twice the standard operating current.

The operating frequency is changed to the standard operating frequency typically after 8–10 cycles or once the electrodes are warm enough to sustain the current path at the standard operating frequency.

It will be appreciated that gas discharge lamps operated according to the present invention will last longer and provide a more stable lumen output over the lifetime of the lamp than the lamps of the prior art since the lamps of the present invention require only one or, at worst, a few sparks for ignition. This significantly reduces electrode wear, sputtering and blackening of the inner walls of the lamp.

It will further be appreciated that, under non-standard operating conditions, the ballast may require more than one spark to ignite the lamp. However, the number of sparks will still be less than is required without the dual frequency operation of the present invention.

Figure 7:
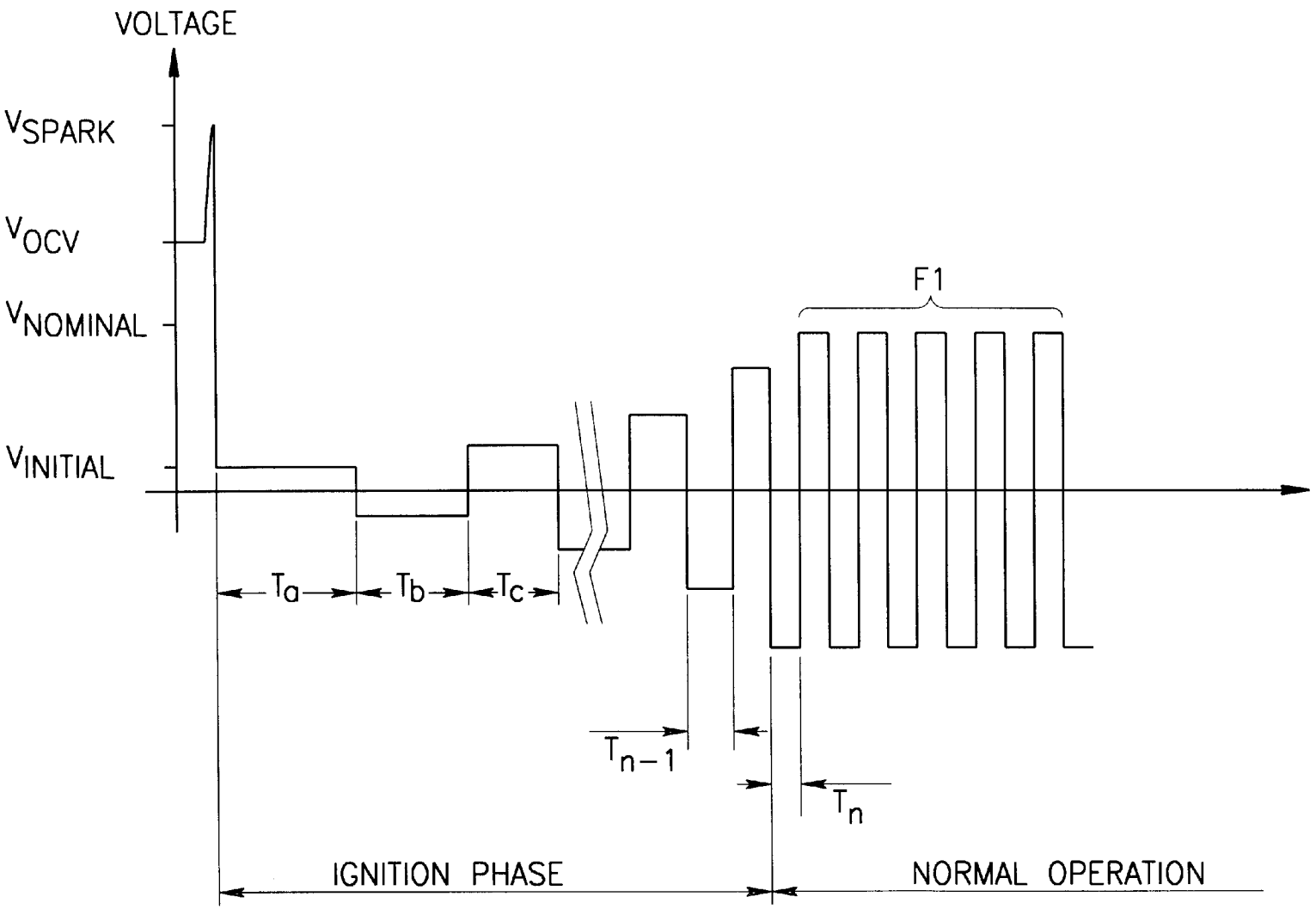
FIG. 7 is a graphical illustration of a multiple frequency operating method, in accordance with an alternative preferred embodiment of the present invention.

Reference is now made to FIG. 7 which illustrates an alternative, embodiment of the present invention which, during the ignition phase, ramps the operating frequency from the low starting frequency to the final operating frequency. FIG. 7 shows the voltage over time across the electrodes and has four voltages of interest, the spark voltage Vspark, the open circuit voltage Vocv, the nominal voltage Vnominal and the initial voltage Vinitial.

As shown in FIG. 7, the length Ti of each period, during which the voltage is constant, decreases until the length associated with the operating frequency F1 is achieved. As can be seen, half-period Tb is smaller than half-period Ta and half-period Tc is smaller than half-period Tb, etc. The decreasing period length is associated with an increasing frequency. Thus, as the electrodes warm up, the frequency of operation is increased until the nominal operating frequency F1 is achieved.

In addition, the voltage at each frequency is also increased by the ballast due to the increase in the internal lamp impedance. Thus, after the spark, the voltage begins at the initial voltage Vinitial and increases with the increased frequency until it reaches Vnominal.

The ignition phase typically lasts 5 to 20 cycles. The rate of increase of frequency can be constant or the frequency can be low for a few cycles and then increased dramatically later, or it can follow any other increasing function to the nominal operating frequency.

Figure 8:
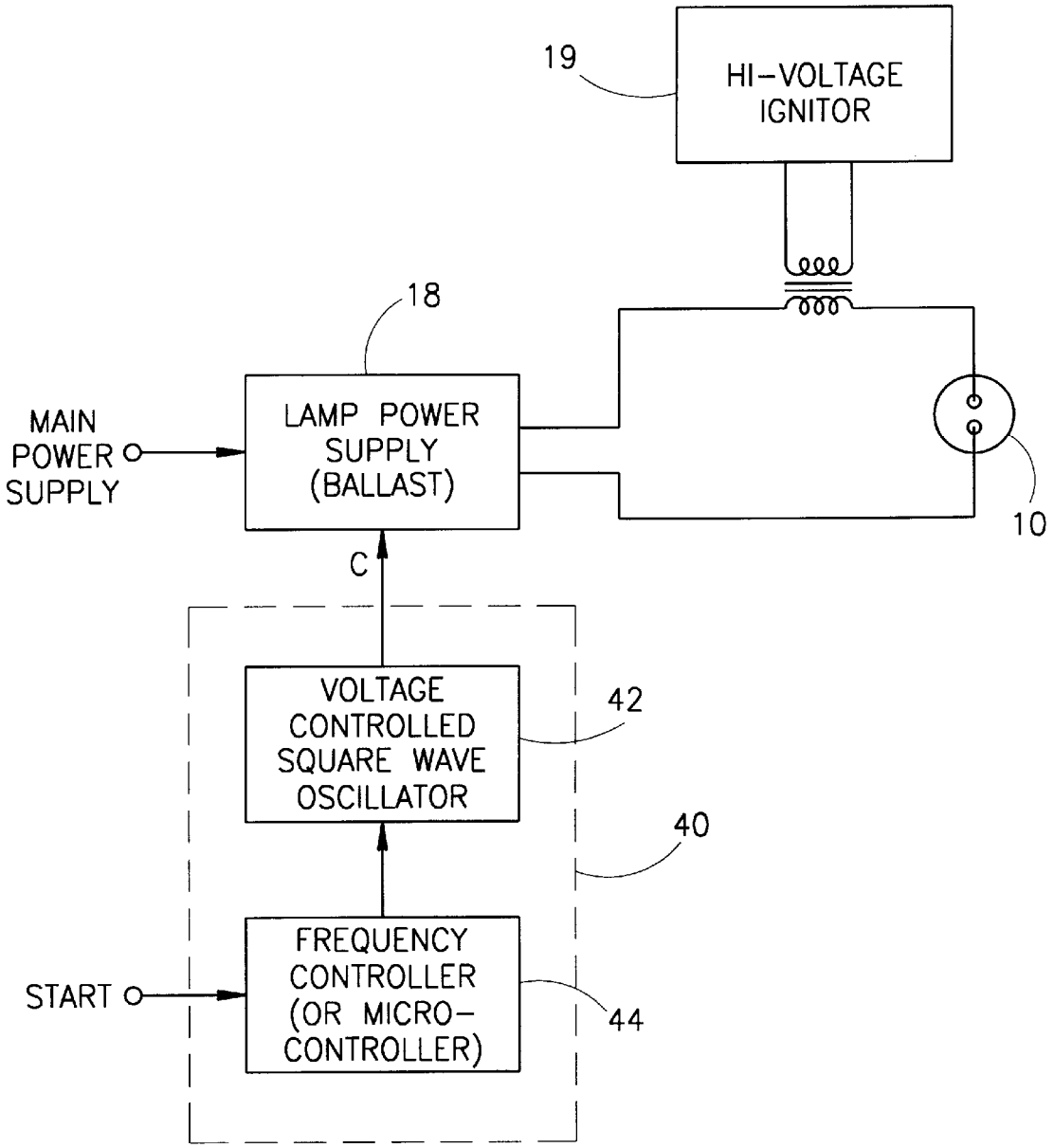
FIG. 8 is a schematic illustration of elements for implementing the dual and multiple frequency operating method of the present invention.

The frequency of operation or, alternatively, the length of the half-periods Ti, can be controlled by any suitable manner. Reference is now briefly made to FIG. 8 which schematically illustrates apparatus 40 for controlling the frequency of operation and the lamp 10 and ballast 18 which are controlled.

Ballast 18 receives the main power supply and controls the lamp 10 in response to signals from the apparatus 40. The apparatus 40 typically comprises a voltage controlled square wave oscillator (VCO) 42 and a frequency controller 44.

Controller 44 can be any suitable unit which can indicate the desired frequency of operation. Controller 44 provides a variable voltage Vo, typically between 0V and 10V, whose voltage level is a function of the desired frequency. The variable voltage Vo is provided to VCO 42 which, in turn, produces a signal C whose frequency is the currently desired frequency. Signal C is provided to the ballast 18 such that, when the signal C changes direction, the ballast 18 changes the direction of the voltage provided to the lamp 10.

Controller 44 can be implemented as a circuit which produces one voltage level Vo for a first period of time (such as the length of 8–10 cycles) and a second voltage level afterward. Alternatively, controller 44 can produce a ramped voltage level Vo which reaches the second voltage level within a predetermined period of time. In a further embodiment, controller 44 can include a microcontroller which selects the frequency and the length of time that the ballast will be operated at that frequency. The controller 44 then produces the desired variable voltage associated with the selected frequency. If desired, the microcontroller can include a temperature sensor from whose output the frequency is chosen. For example, when the temperature is low, the frequency is set to a low frequency (long period).

It will be appreciated by persons skilled in the art that the present invention is not limited by what has been particularly shown and described herein above. Rather the scope of the invention is defined by the claims that follow:

What is claimed is:

1. A method of operating a high intensity discharge lamp, the method comprising the steps of:

during ignition operating said high intensity discharge lamp at an initial alternating current frequency which is lower than an operating alternating current frequency; and later operating said high intensity discharge lamp at said operating alternating current frequency.

2. A method according to claim 1 and wherein said step of later operating occurs once said high intensity discharge lamp has substantially achieved a standard operating voltage.

3. A method according to claim 1 and wherein said initial alternating current frequency has a period which is long enough to maintain gas ionization during an alternating current voltage direction change.

4. A method according to claim 1 and wherein the change from the initial alternating current frequency to the second alternating current frequency is a step function.

5. A method according to claim 1 and wherein the change from the initial alternating current frequency to the second alternating current frequency is a ramp function.

6. A method according to claim 1 and wherein the change from the initial alternating current frequency to the second alternating current frequency is an increasing function.

7. A high intensity discharge lamp system comprising:

a high intensity discharge lamp;

a ballast for providing an alternating current voltage to said high intensity discharge lamp; and a frequency changer which selects an initial alternating current frequency at which said ballast provides said alternating current voltage and which changes said alternating current frequency to a second alternating current frequency, wherein said second frequency is an operating frequency and said initial frequency is lower than said operating frequency.

8. A lamp system according to claim 7 and wherein said frequency changer selects said second alternating current frequency once said high intensity discharge lamp has substantially achieved a standard operating voltage.

9. A lamp system according to claim 7 and wherein said initial alternating current frequency has a period which is long enough to maintain gas ionization during an alternating current voltage direction change.

10. A lamp system according to claim 7 and wherein the change from the initial alternating current frequency to the second alternating current frequency is a step function.

11. A lamp system according to claim 7 and wherein the change from the initial alternating current frequency to the second alternating current frequency is a ramp function.

12. A lamp system according to claim 7 and wherein the change from the initial alternating current frequency to the second alternating current frequency is an increasing function.

* * * * *